US010327537B2

(12) United States Patent
Gresham

(10) Patent No.: US 10,327,537 B2
(45) Date of Patent: Jun. 25, 2019

(54) BEVERAGE HOLDER

(71) Applicant: Stubby Strip Pty Ltd, Pyrmont, New South Wales (AU)

(72) Inventor: Brett Gresham, Plympton (AU)

(73) Assignee: Stubby Strip Pty Ltd, Pyrmont, New South Wales (AU)

( * ) Notice: Subject to any disclaimer, the term of this patent is extended or adjusted under 35 U.S.C. 154(b) by 0 days.

(21) Appl. No.: 14/803,669

(22) Filed: Jul. 20, 2015

(65) Prior Publication Data

US 2016/0316899 A1 Nov. 3, 2016

(51) Int. Cl.
*A45F 5/00* (2006.01)
*A45F 5/02* (2006.01)
*A45F 3/14* (2006.01)

(52) U.S. Cl.
CPC ..... *A45F 5/00* (2013.01); *A45F 5/021* (2013.01); *A45F 2003/142* (2013.01); *A45F 2003/144* (2013.01); *A45F 2005/006* (2013.01); *A45F 2005/008* (2013.01); *A45F 2200/0583* (2013.01)

(58) Field of Classification Search
CPC ..... A45F 2200/0583; B65D 81/3876; B65D 81/3879
USPC ..... 224/148.4, 582, 583
See application file for complete search history.

(56) References Cited

U.S. PATENT DOCUMENTS 4,526,280 A * 7/1985 Taylor ..... B65D 77/0406 150/154
4,802,602 A * 2/1989 Evans ..... B65D 81/3886 220/739
5,065,879 A * 11/1991 King ..... B65D 81/3886 150/154
5,775,722 A * 7/1998 Moore ..... B60R 21/00 150/166
2007/0221693 A1* 9/2007 Moore ..... A45F 3/16 224/148.6
2011/0303708 A1* 12/2011 Dudley ..... A45F 5/00 224/148.1

* cited by examiner

*Primary Examiner* — Adam J Waggenspack
(74) *Attorney, Agent, or Firm* — Dority & Manning, P.A.

(57) ABSTRACT

A beverage holder including a base and a wall extending away from the base to a rim to surround an opening. The rim, wall and base defining a space within which a beverage can be held in use. A longitudinally extending flap is extendable from said wall and includes a first side and a second side. A fastener is located in use on said first and said second sides so that in use said flap can extend at least partially about said wall so that the fastener of said first side can connect with the fastener of said second side and/or another like holder.

6 Claims, 27 Drawing Sheets

BEVERAGE HOLDER

FIELD

The present invention relates to a beverage holder and in particular to a beverage holder that is portable and connectable to like beverage holders and includes methods of cooling the beverage being held by the holder.

BACKGROUND

There are many types of "coolers" and "holders" for beverages and the like. For example, cooler bags whereby food, beverages and other items are placed inside, insulated bags that keep products cold. Such bags typically include a zippered lid or the like and carry handles. In effect, such bags are similar to the operation of a normal bag with the addition of insulated walls.

Further, "stubbies" or "beer coolers" are known particularly for holding beer cans or soft drink cans during hot periods to keep the beverages within the cans cold whilst being held in a hand of a user. Such devices are typically made of relatively cheap material such that they provide limited insulation.

Polystyrene type containers have also been used but are rigid, easily damaged and difficult to store.

There is a need for a holder that can hold more than one beverage can simultaneously without being the size of a regular shopping bag, but also having the ability to easily vary the number of beverages to be held and the ability to free up a user's hands.

OBJECT OF THE INVENTION

It is an object of the present invention to substantially overcome or at least ameliorate one or more of the disadvantages of the prior art, or to at least provide a useful alternative.

SUMMARY OF THE INVENTION

There is disclosed herein a beverage holder, said holder including a base and a wall extending away from the base to a rim surrounding an opening;

the rim, wall and base defining a space within which a beverage can be held in use;

a longitudinally extending flap extendable from said wall and having a first side and a second side;

fastening means locatable in use on said first and said second sides so that in use said flap can extend about said wall so that fastening means of said first side can connect with fastening means of said second side and/or another like holder.

Preferably, said fastening means include hook and loop type fasteners.

Preferably, said wall includes insulating material.

Preferably, said wall is neoprene.

Preferably, said flap is substantially rectangular and said fastening means includes two or more hook and loop type fastener strips on each side.

Preferably, said strips extend about the wall of said holder.

Preferably, including a fastener adapted for receipt of a bag strap. This strap can be used to clip one or more holders to any other object including backpacks, pant loops, belts or the like.

Preferably, said fastener is a metal ring and the strap is connected to metal rings on two connected holders.

Preferably, including a pocket to store items.

Preferably, the holder in use is adapted to be secured to a plurality of like holders to enable a plurality of beverages to be carried simultaneously.

Preferably, a size of said opening can be adjusted by the tightening or loosening of said flap about said holder.

BRIEF DESCRIPTION OF DRAWINGS

A preferred embodiment of the invention will now be described, by way of example only, with reference to the accompanying drawings, wherein.

DESCRIPTION OF EMBODIMENTS

Figure 1A:
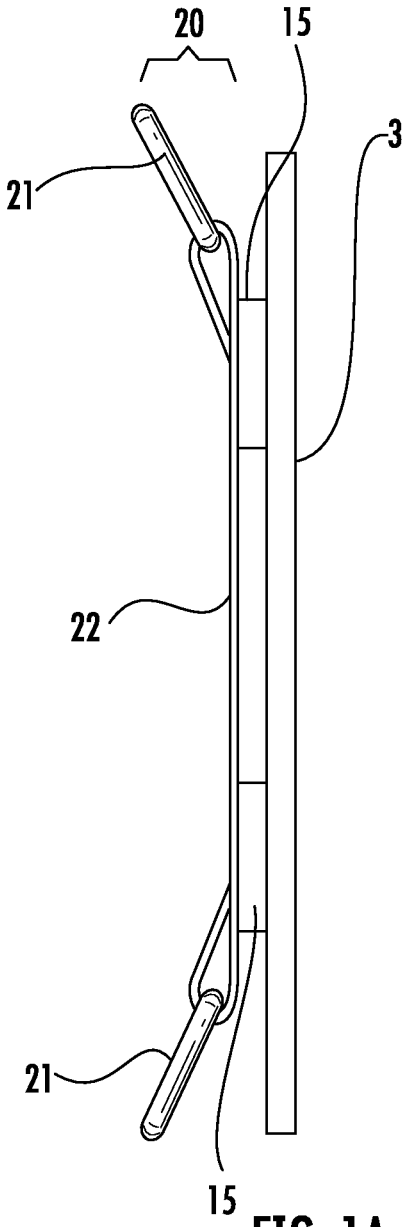
FIGS. 1*a* to 1*d* show a beverage holder according to an embodiment of the invention.
Figure 1B:
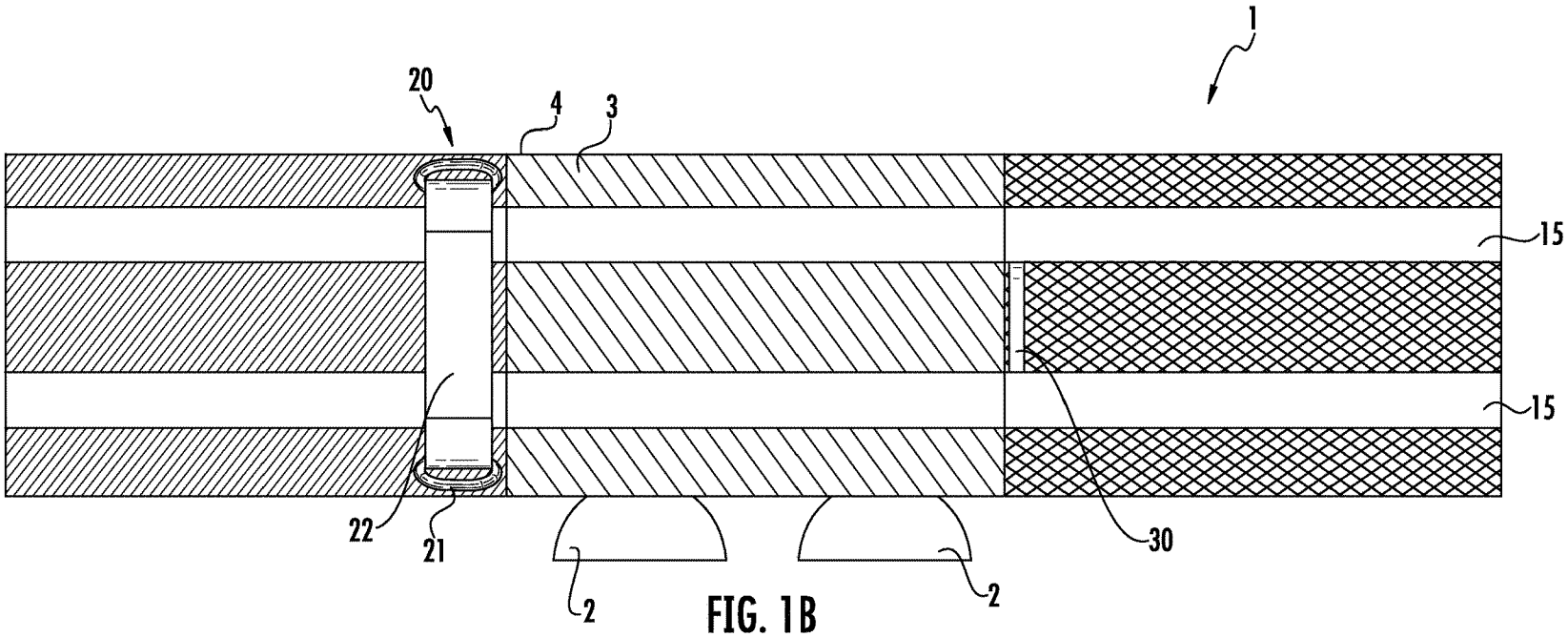
Figure 1C:
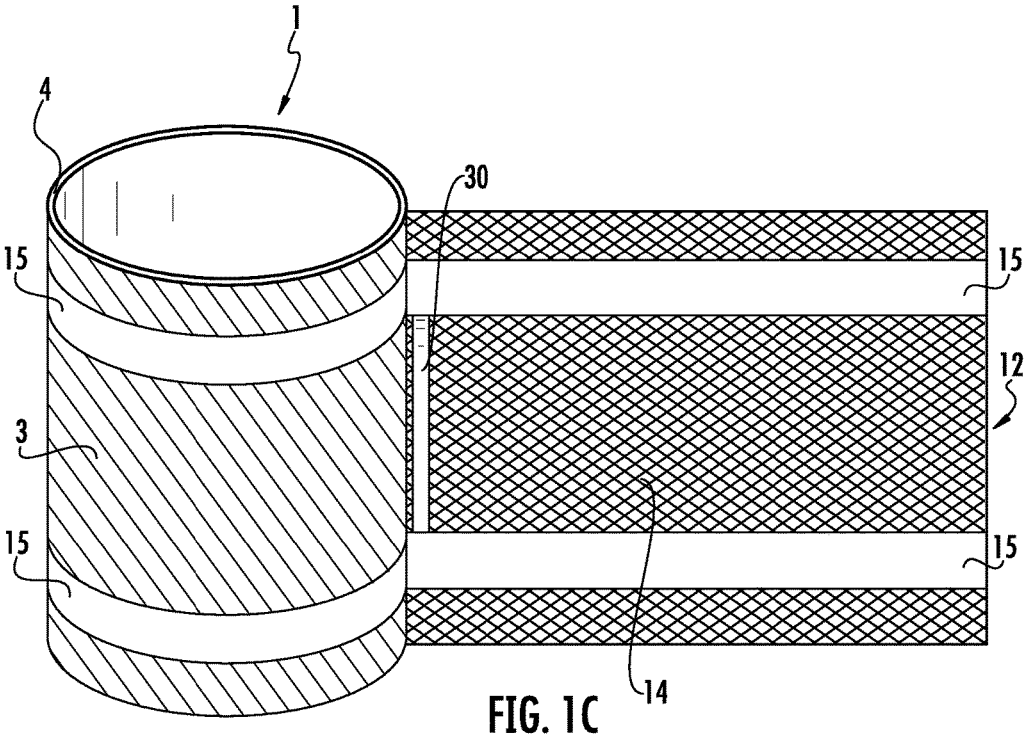
Figure 1D:
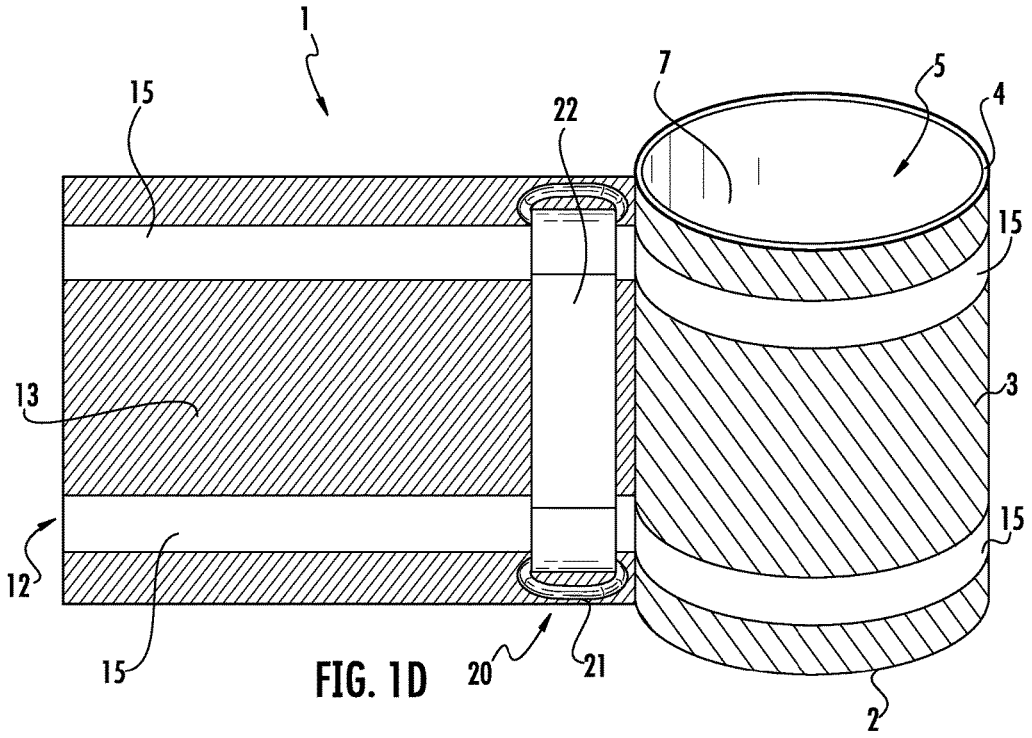
Figure 2A:
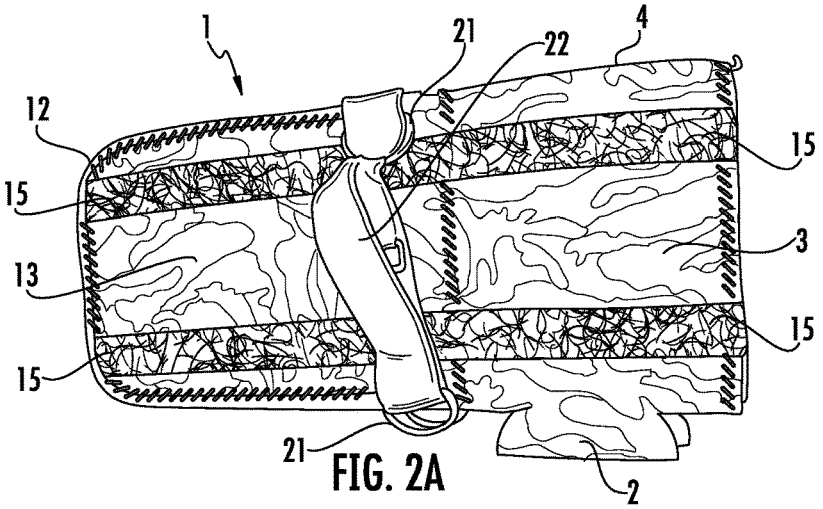
FIGS. 2*a* to 2*c* show another beverage holder of an embodiment of the invention.
Figure 2B:
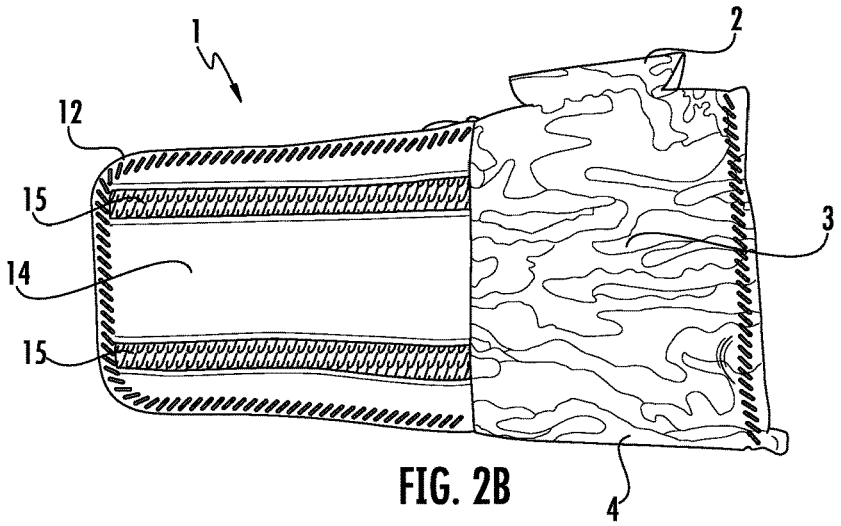
Figure 2C:
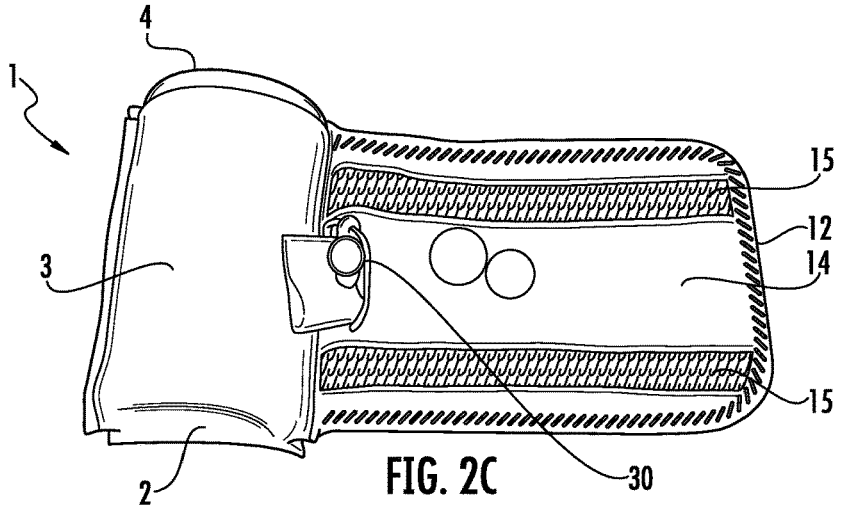
Figure 3A:
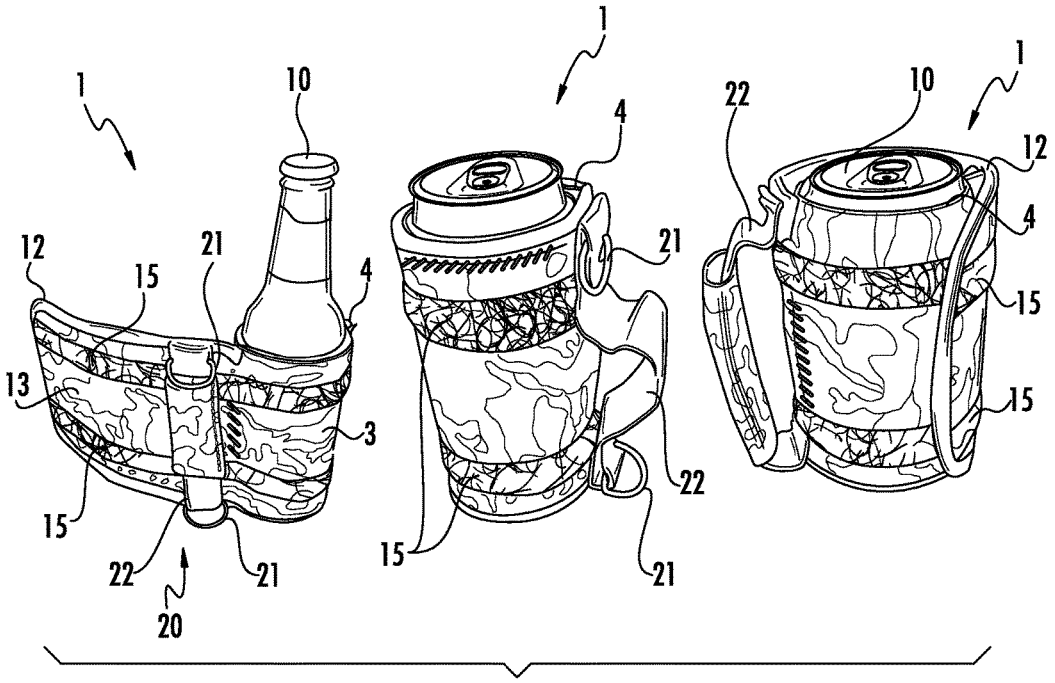
FIGS. 3*a* to 3*b* show an embodiment of a beverage holder in a use position.
Figure 3B:
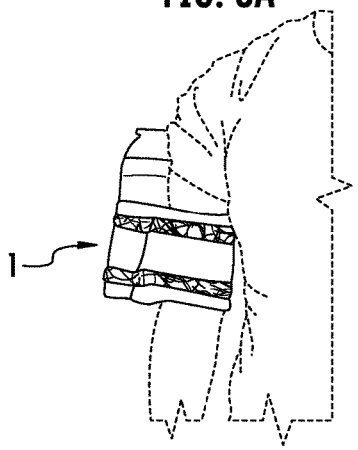
Figure 4:
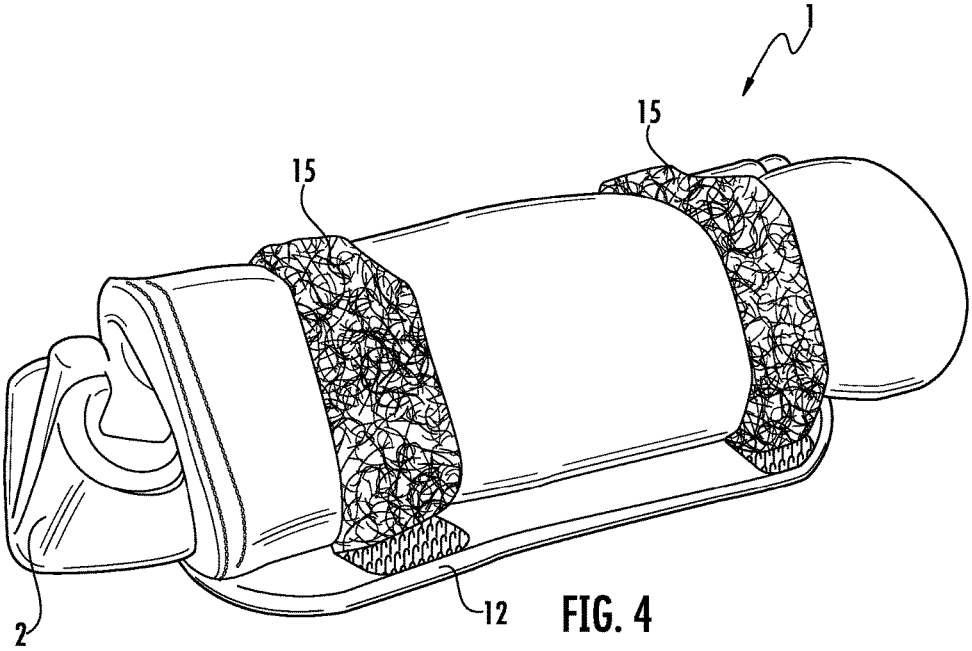
FIG. 4 shows a beverage holder in a rolled up position.
Figure 5:
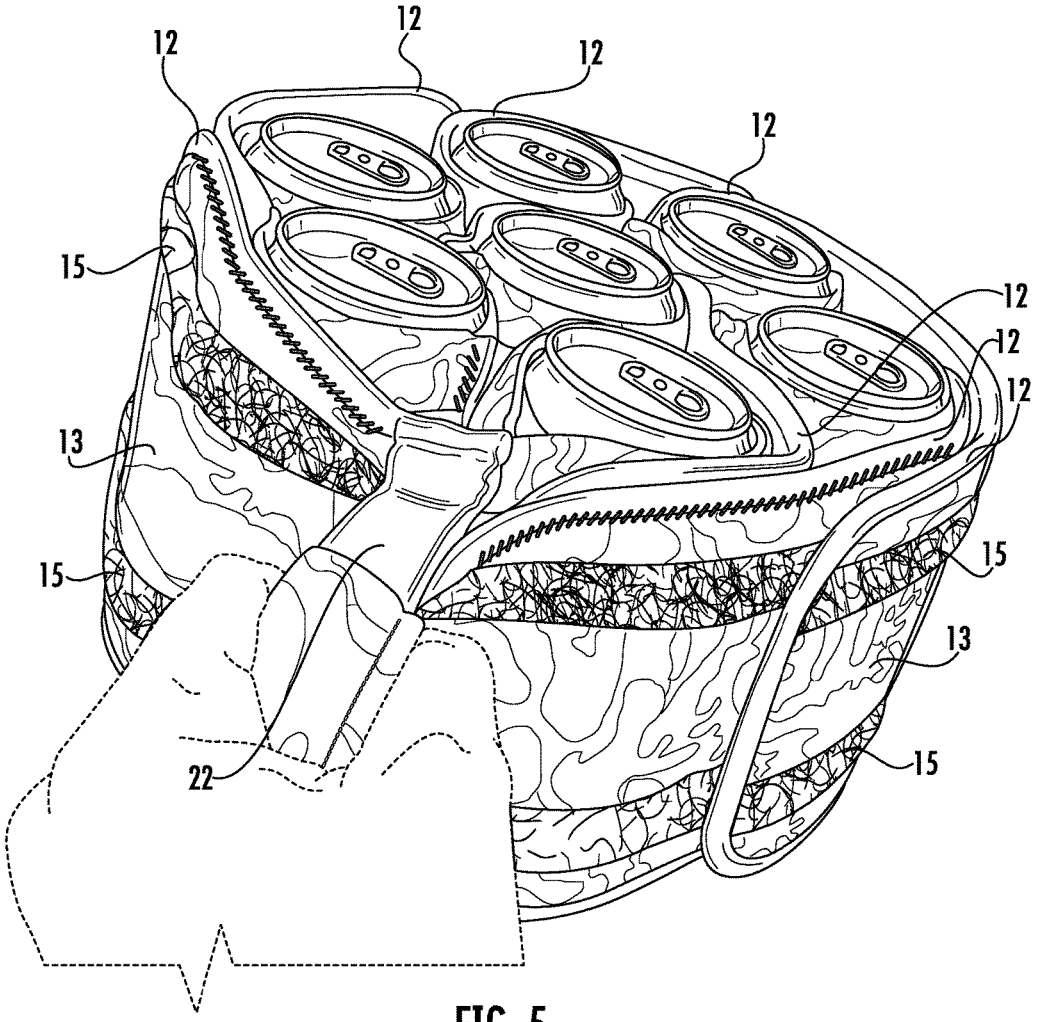
FIGS. 5 to 8 show a plurality of beverage holders connected together in use.
Figure 6:
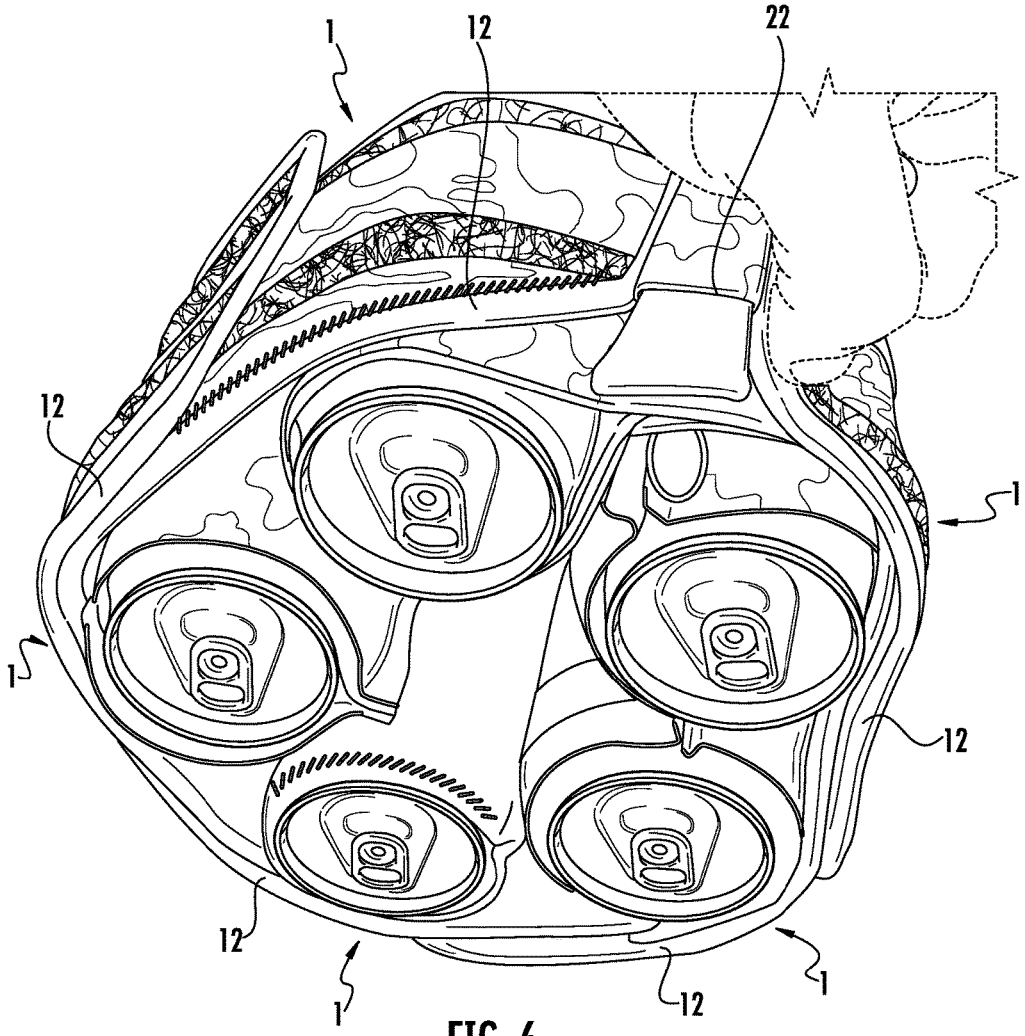
Figure 7:
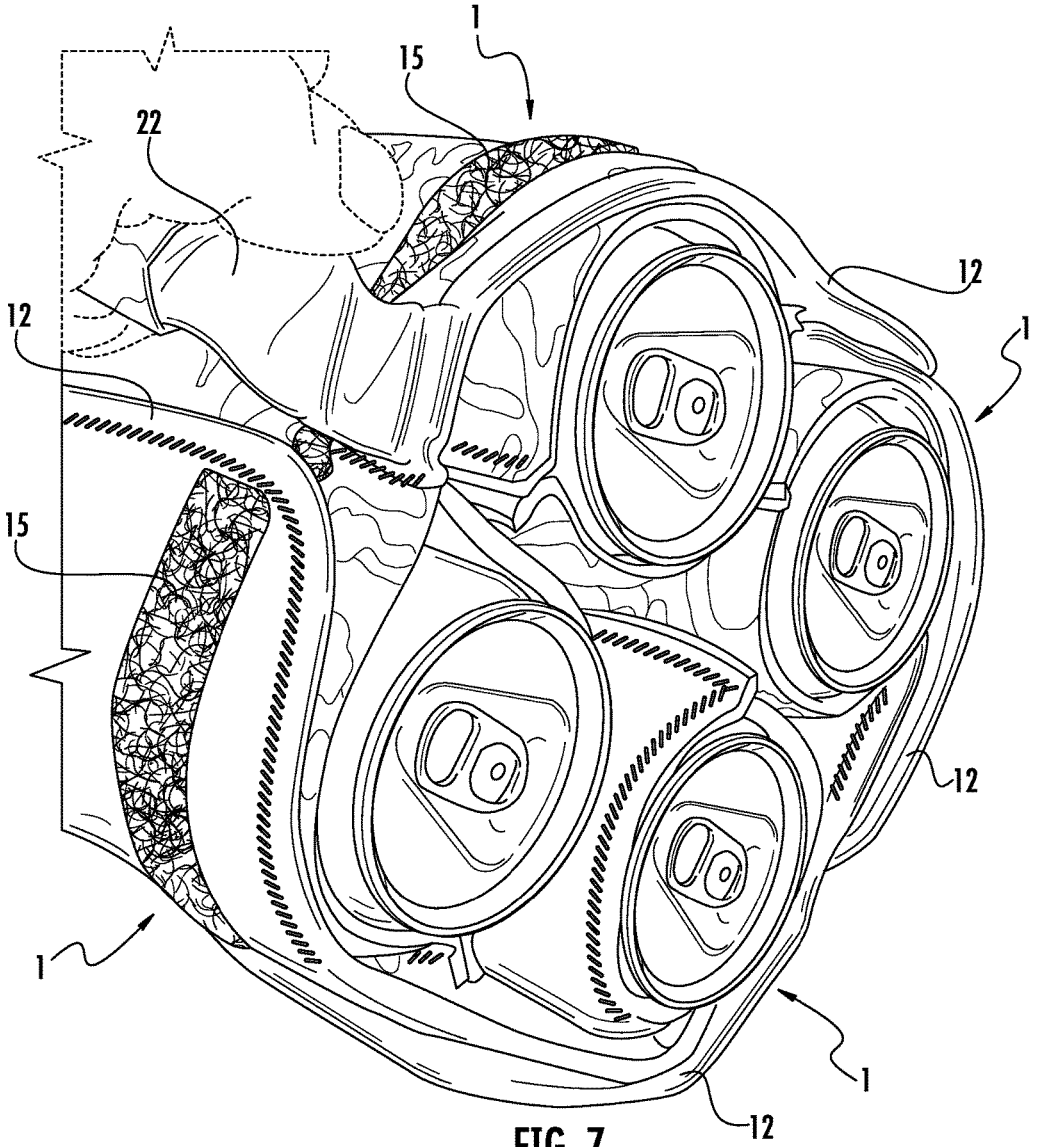
Figure 8:
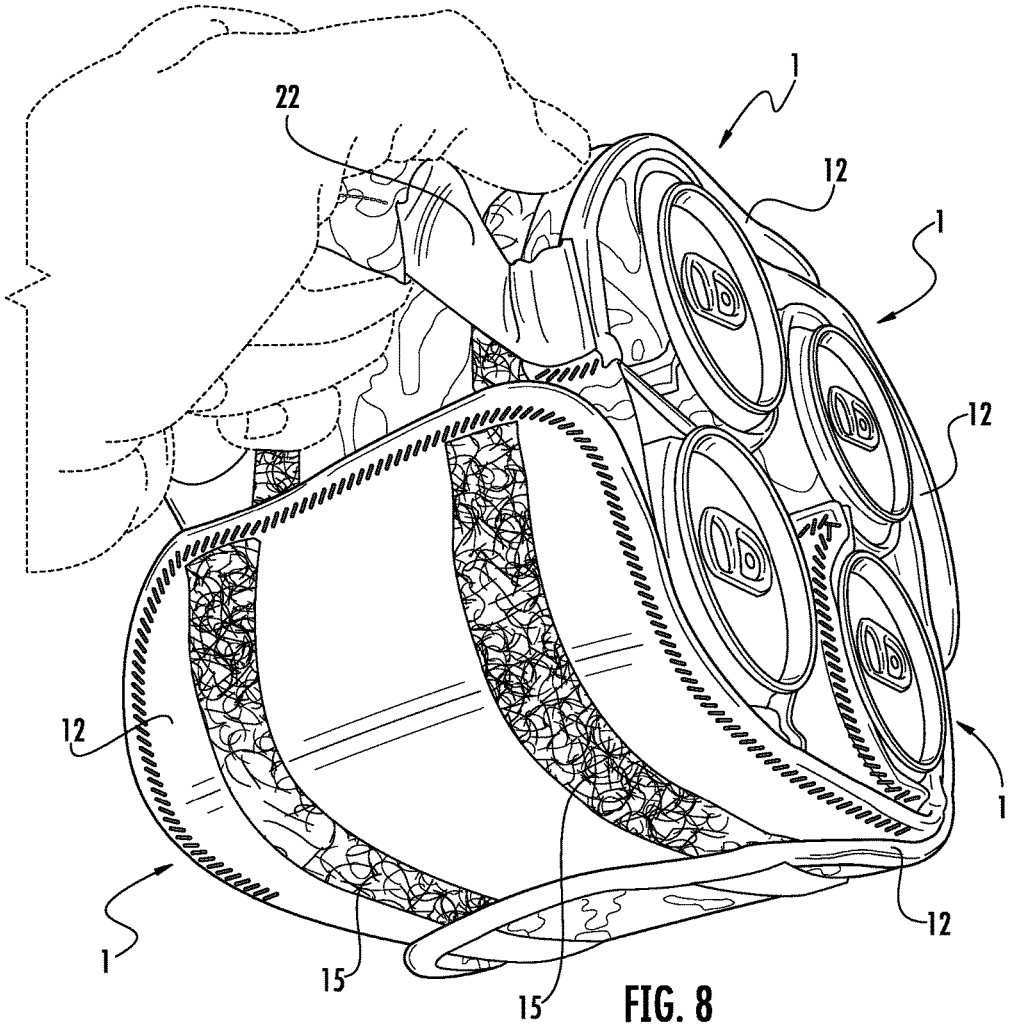
Figure 9:
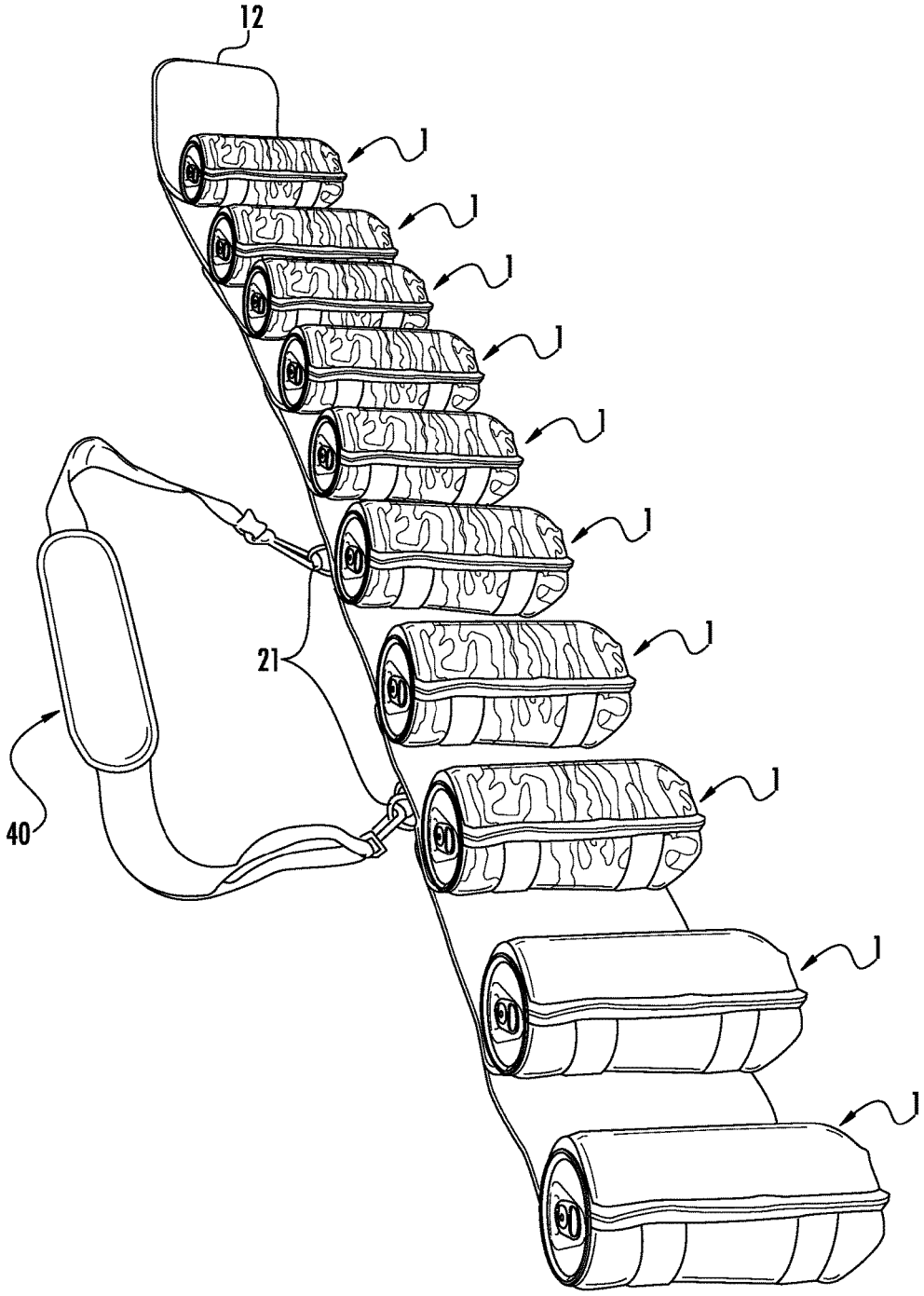
FIG. 9 shows a plurality of beverage holders connected together in use with a carry strap.
Figure 10:
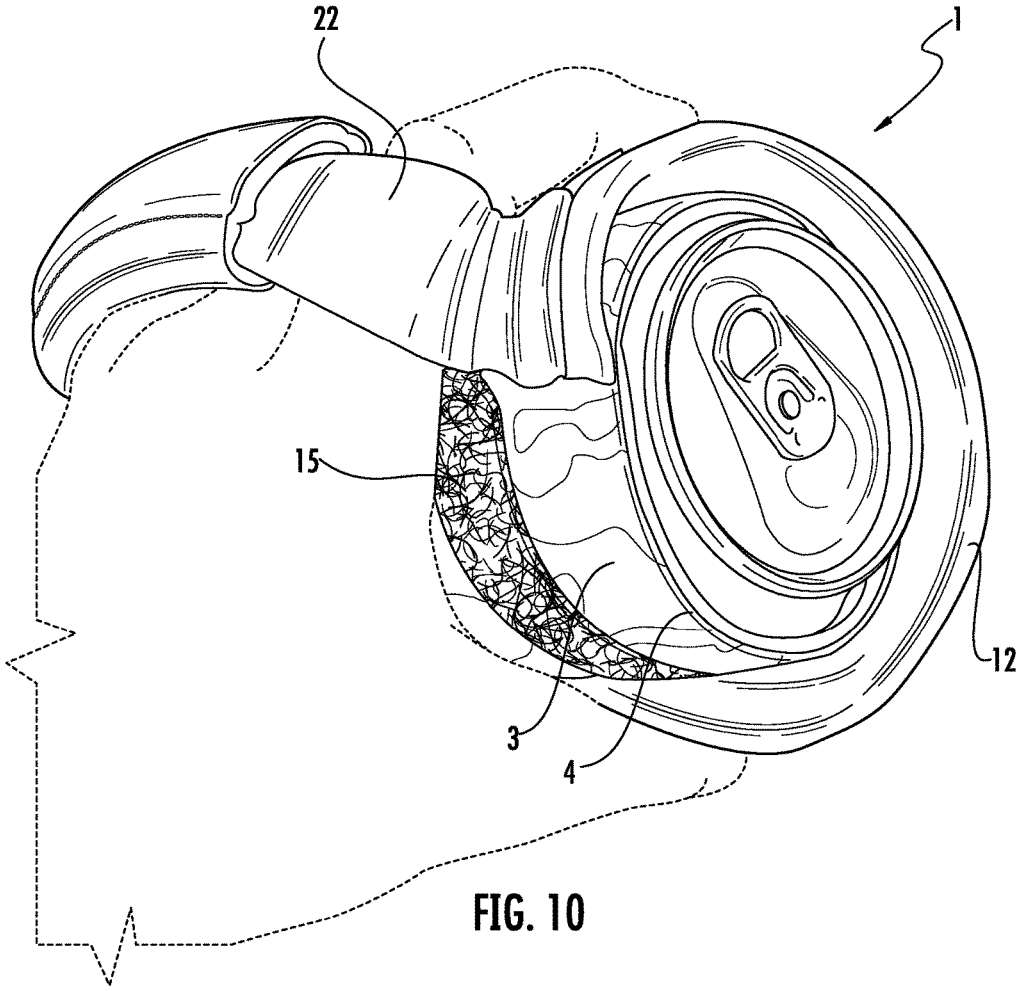
FIG. 10 shows a single hand-held beverage holder.
Figure 11:
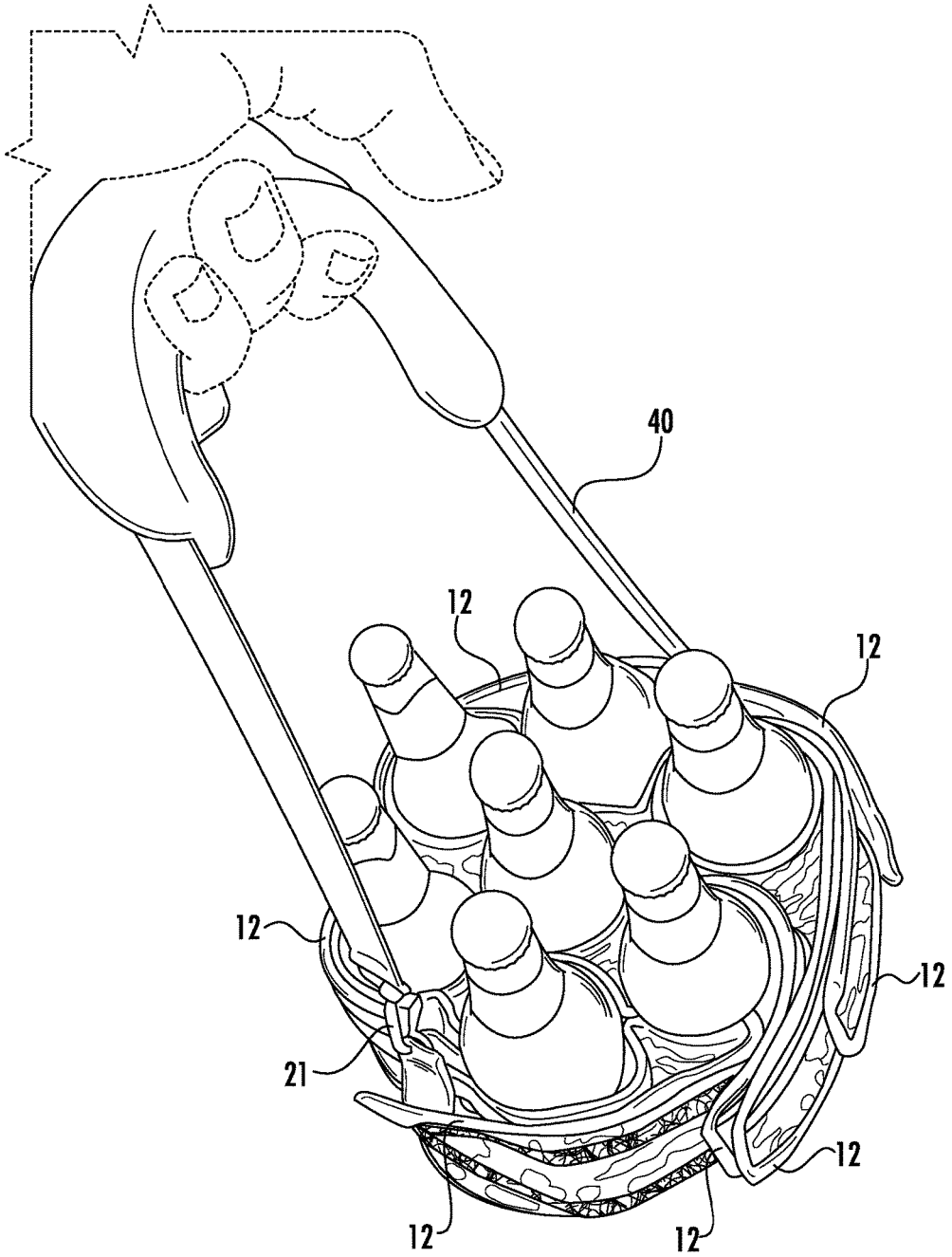
FIG. 11 shows a plurality of beverage holders connected together in use.
Figure 12:
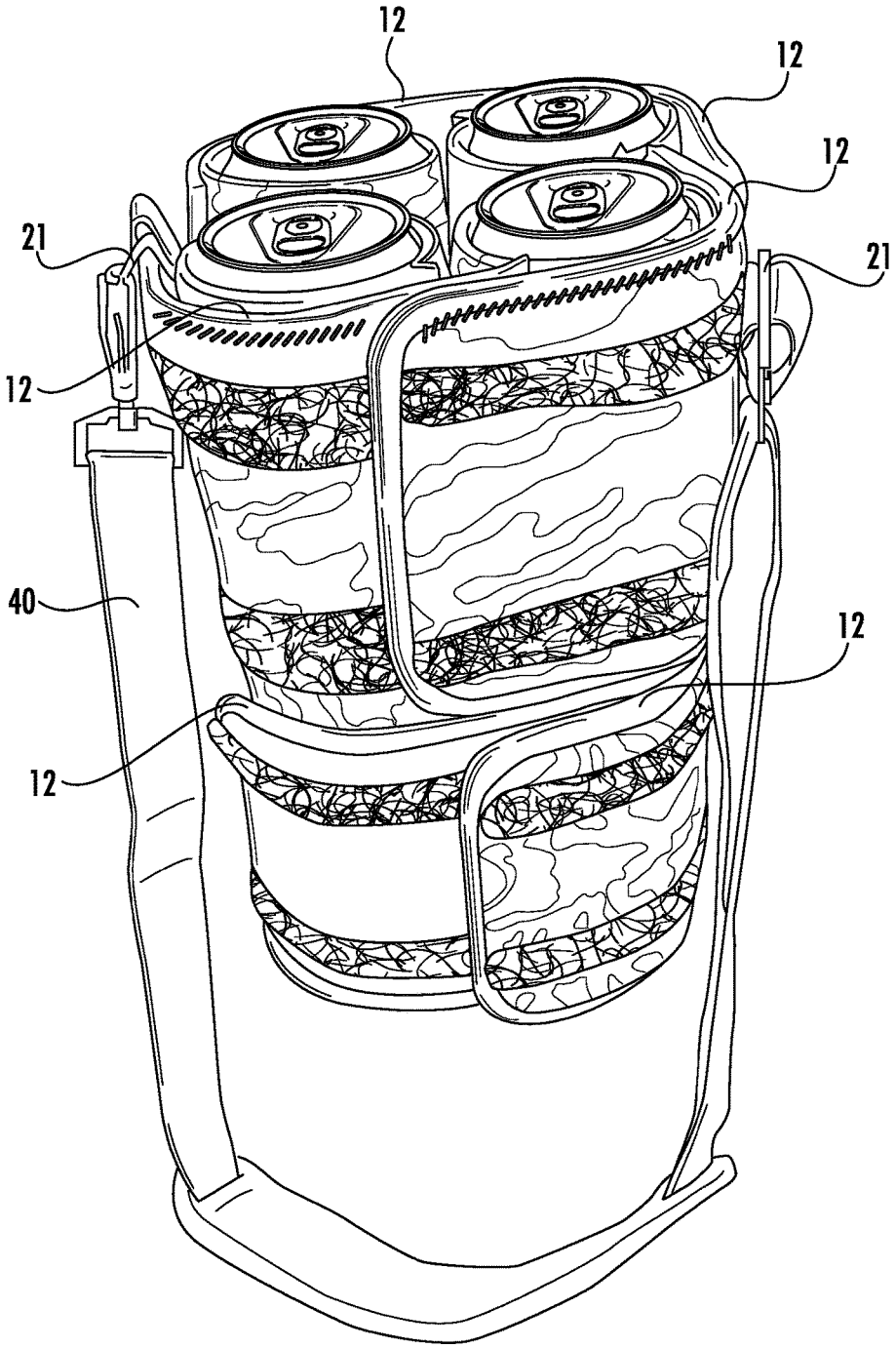
FIG. 12 shows a plurality of beverage holders connected together in a stacked configuration.
Figure 13:
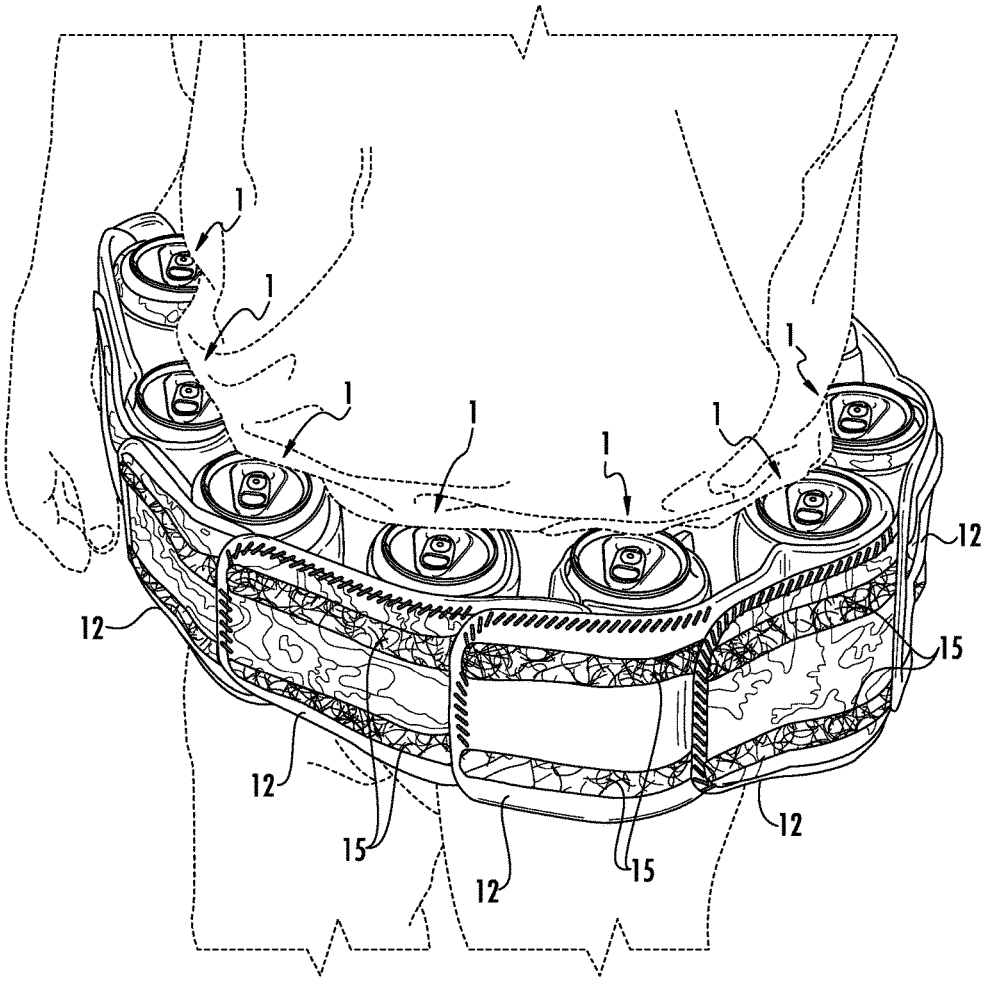
FIGS. 13 and 14 show a plurality of beverage holders connected together in use.
Figure 14:
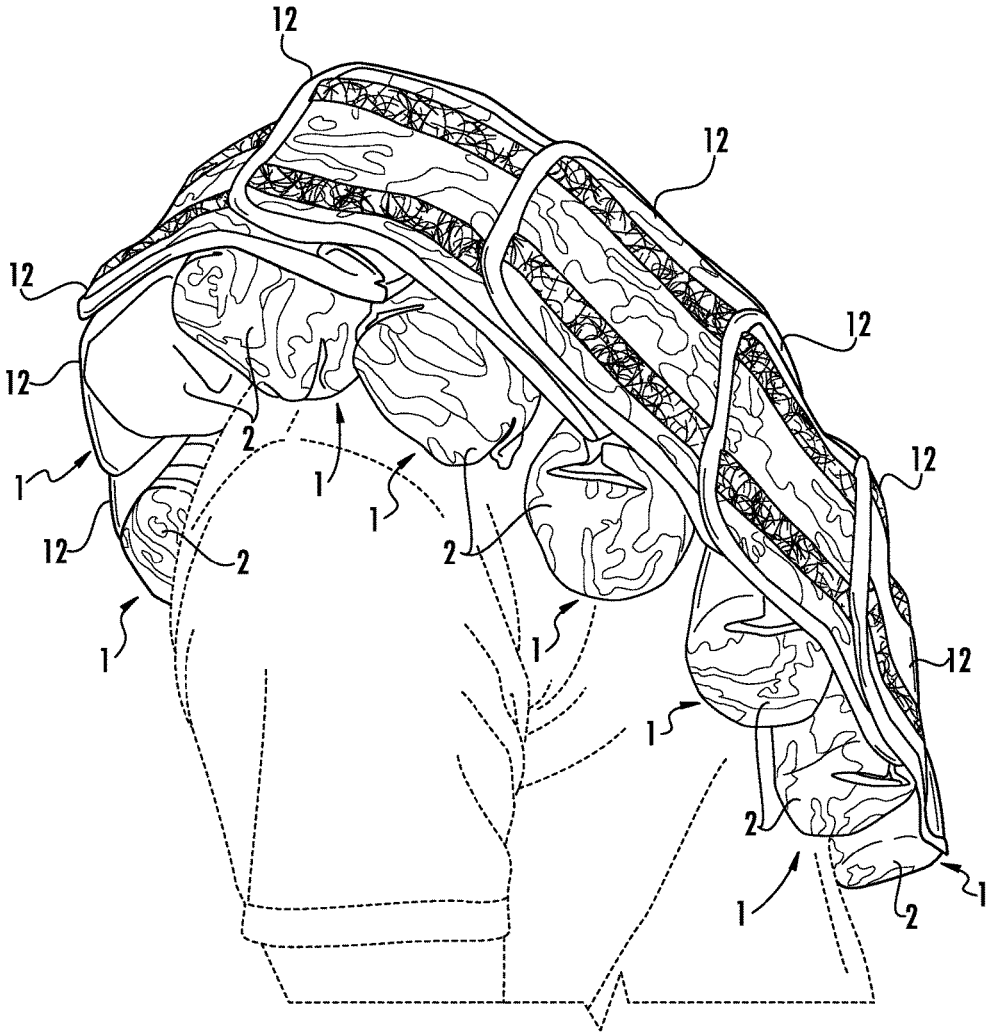
Figure 15:
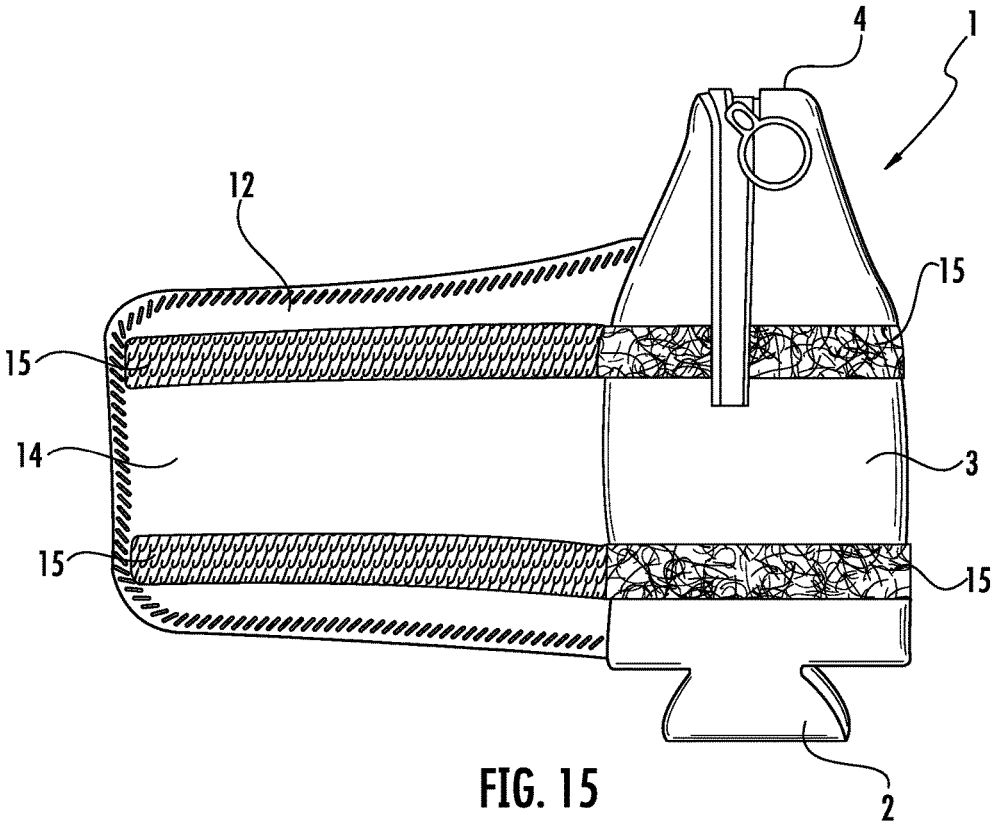
FIG. 15 shows a beverage holder with a zip. The holder is versatile to carry bottles and cans, where this embodiment shows providing insulation right up the neck of the bottle.
Figure 16:
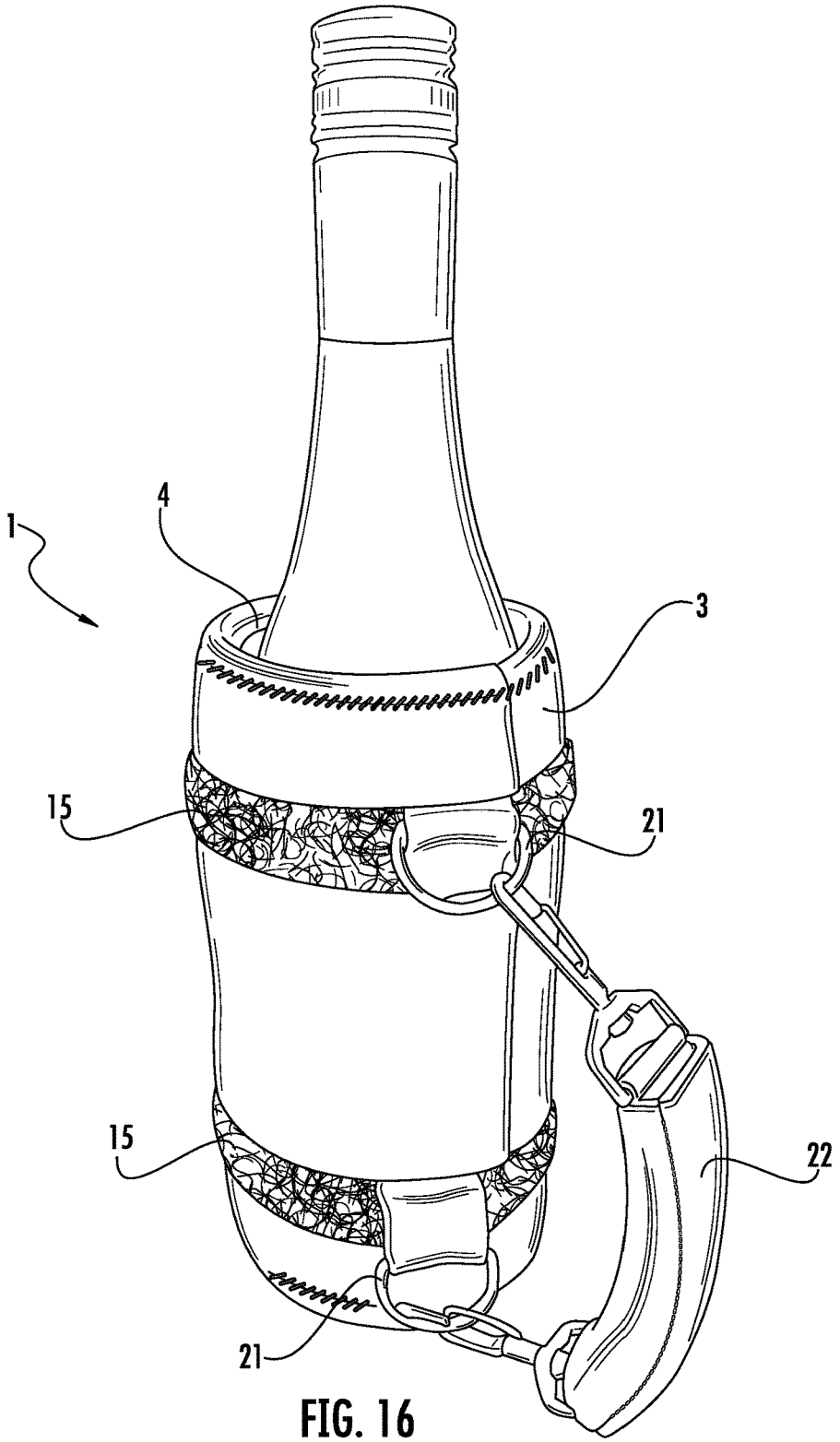
FIG. 16 shows a beverage holder in use holding a bottle including a carry strap.
Figure 17:
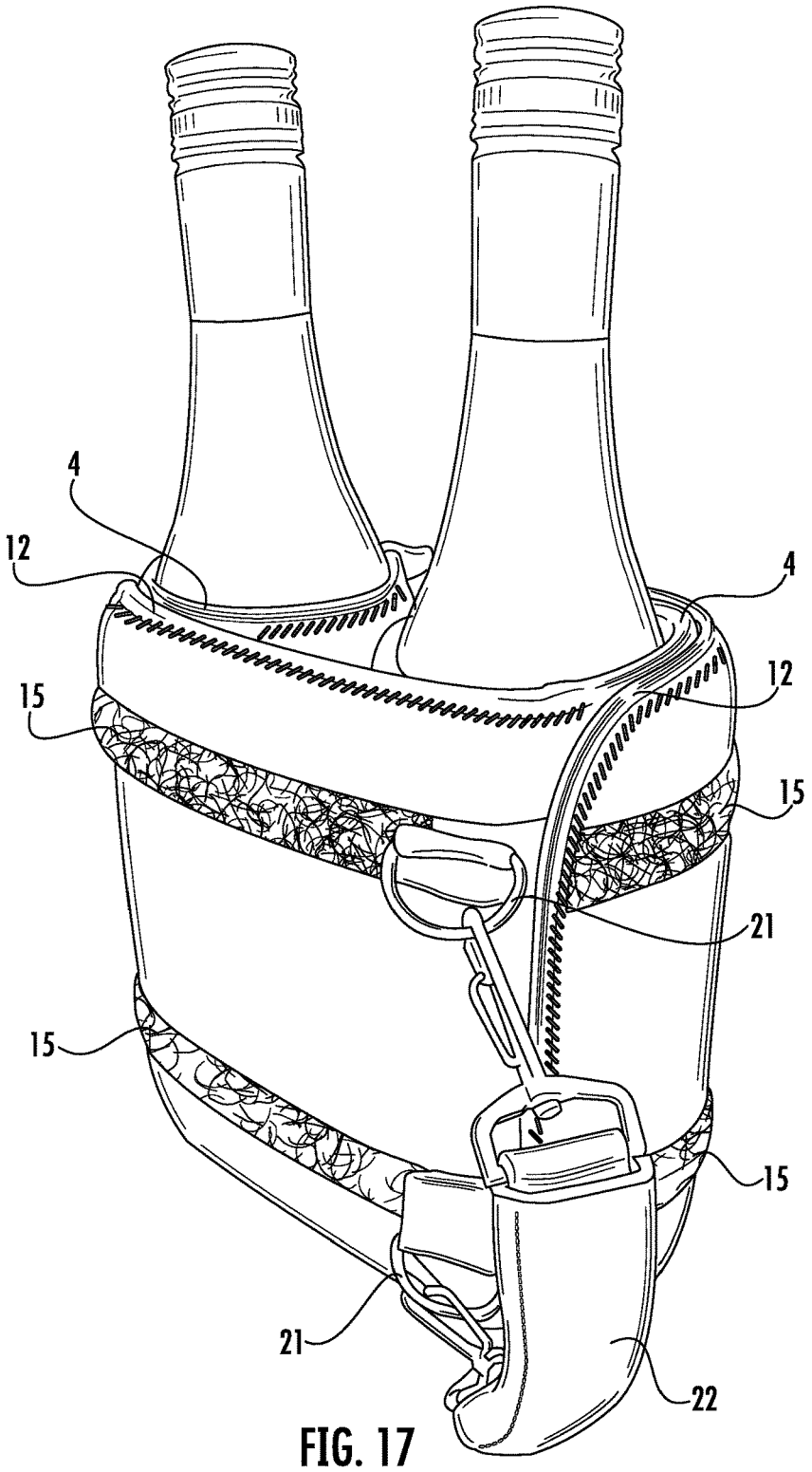
FIGS. 17 to 19 show a beverage holder carrying many bottles.
Figure 18:
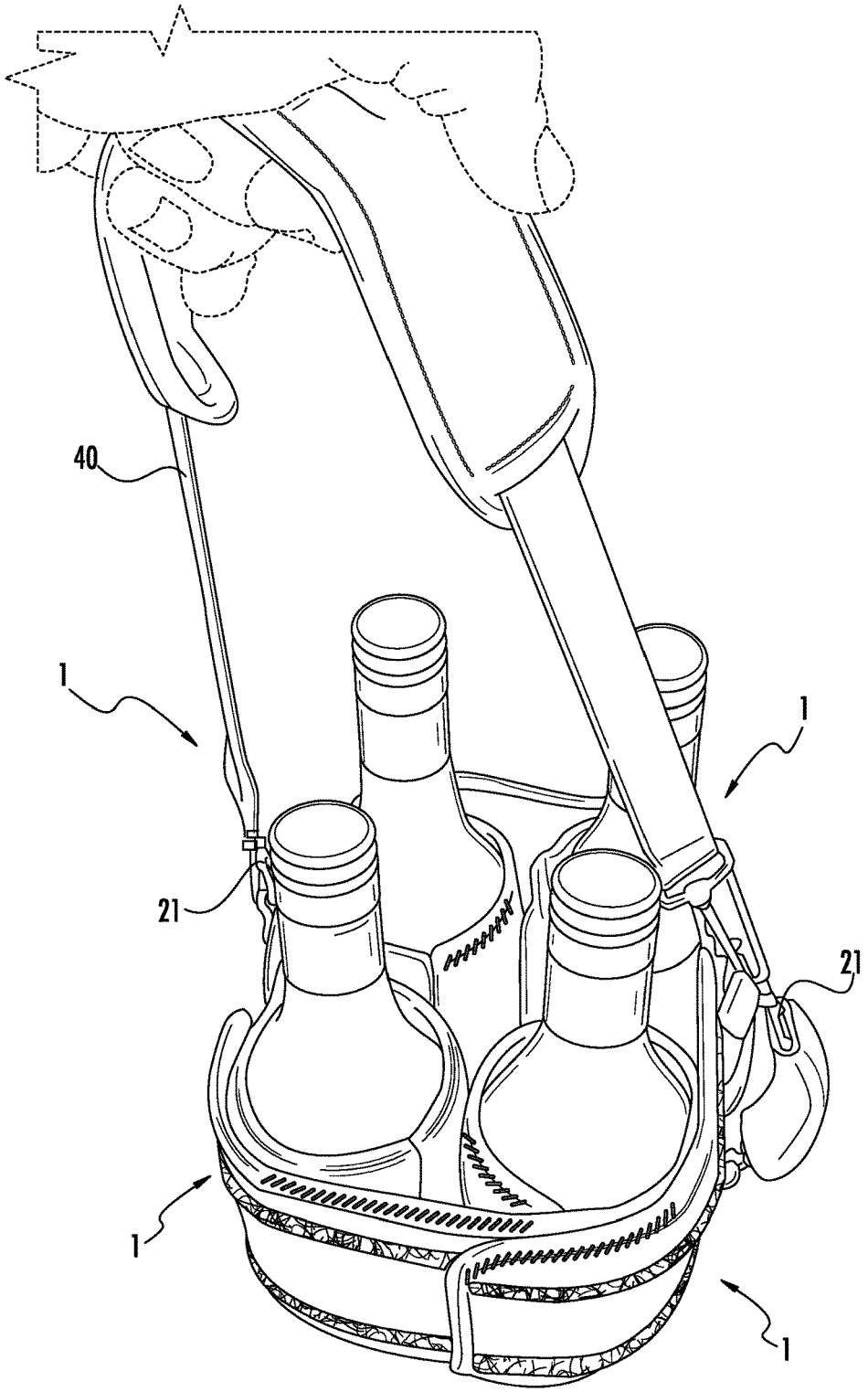
Figure 19:
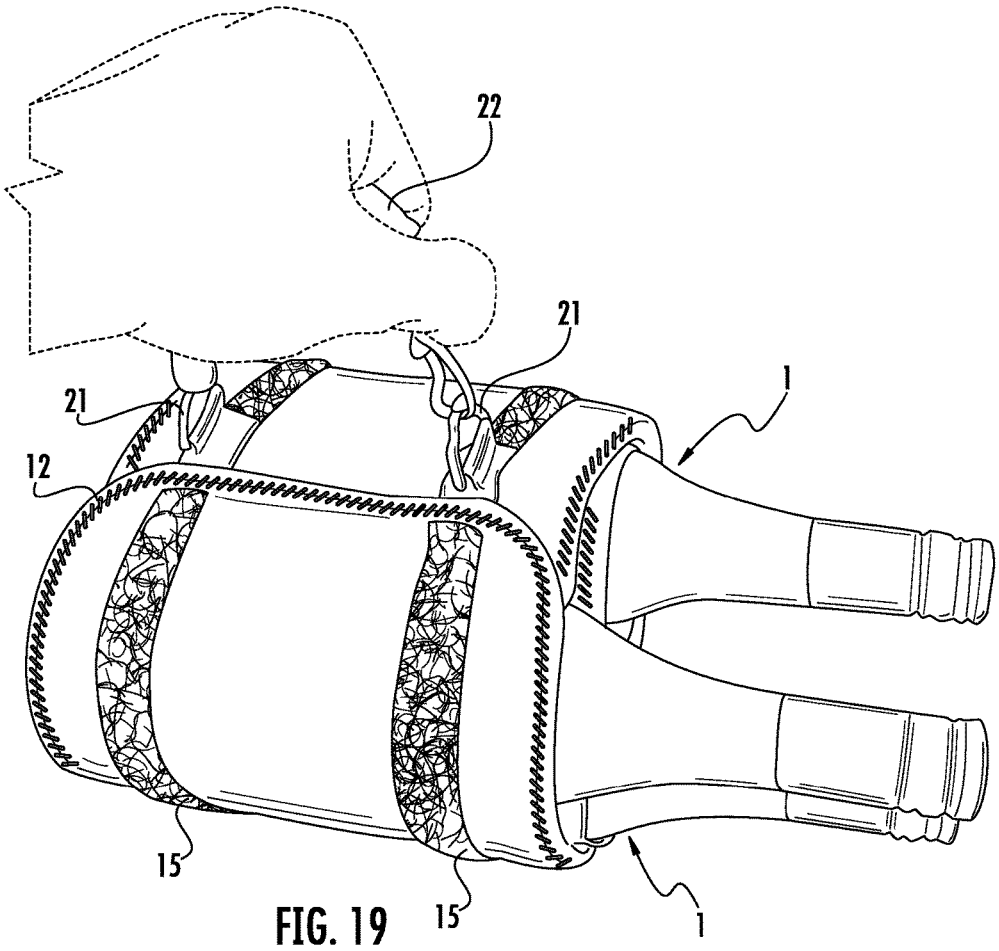
Figure 20:
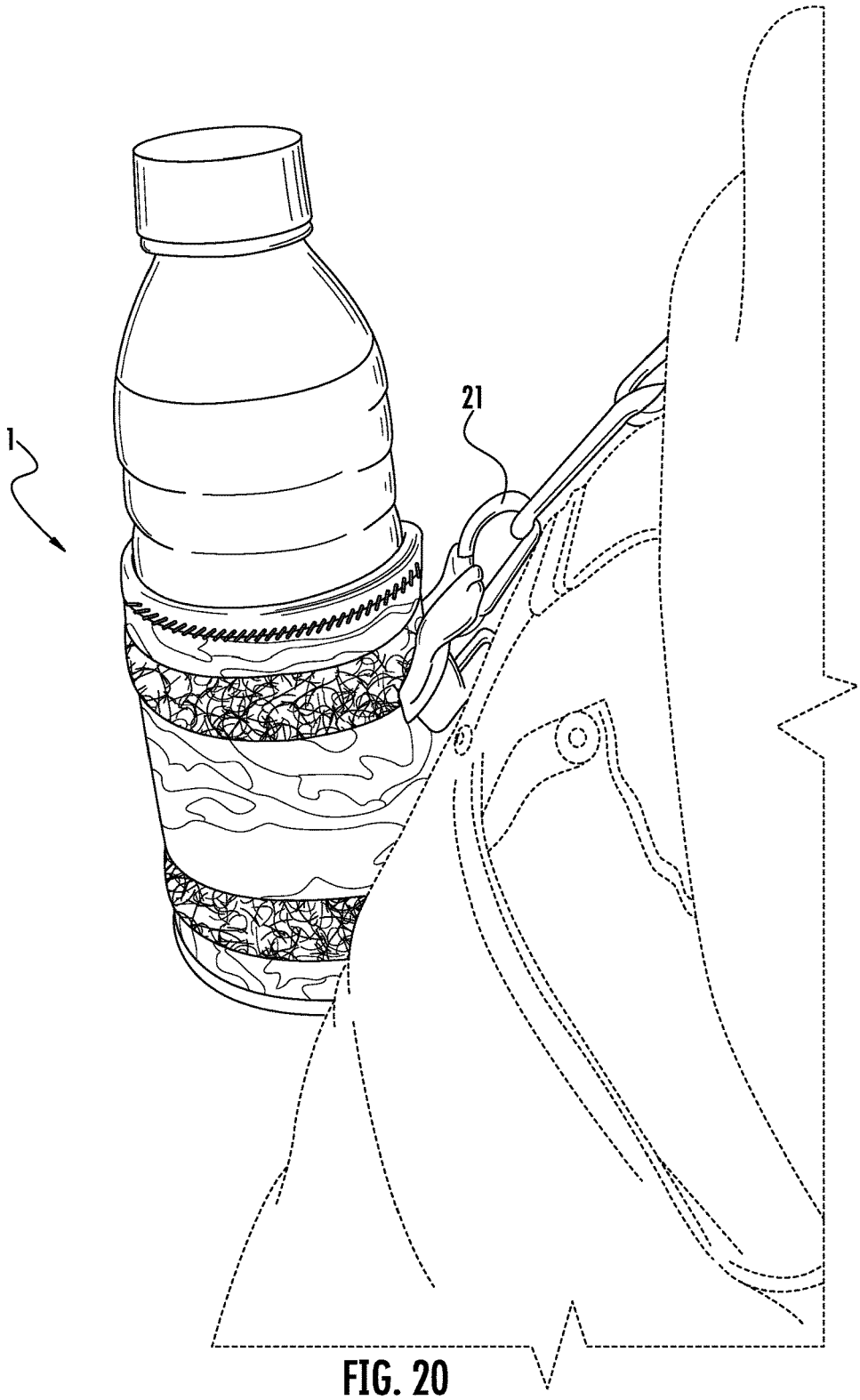
FIGS. 20 to 24 show beverage holders of alternate embodiments.
Figure 21:
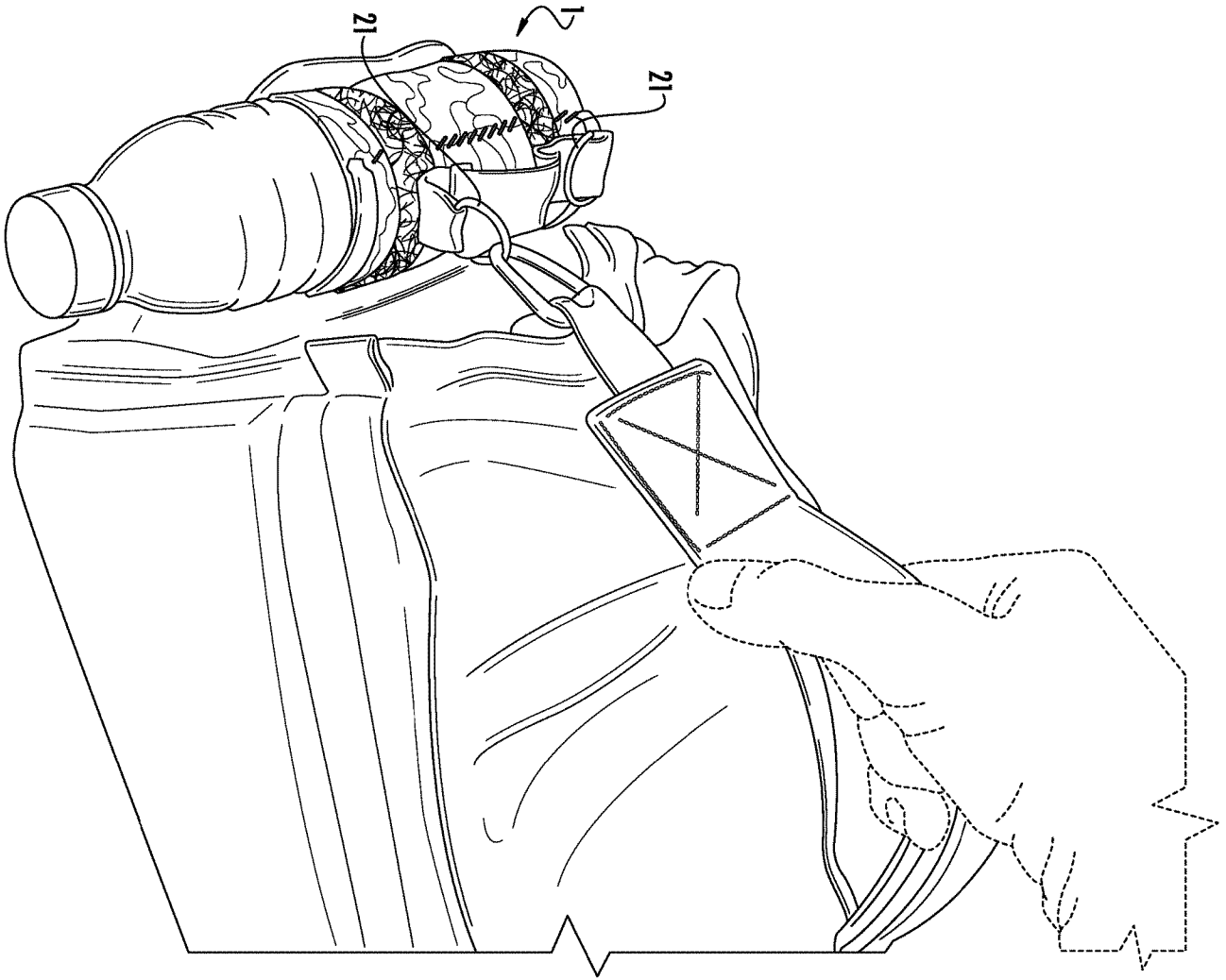
Figure 22:
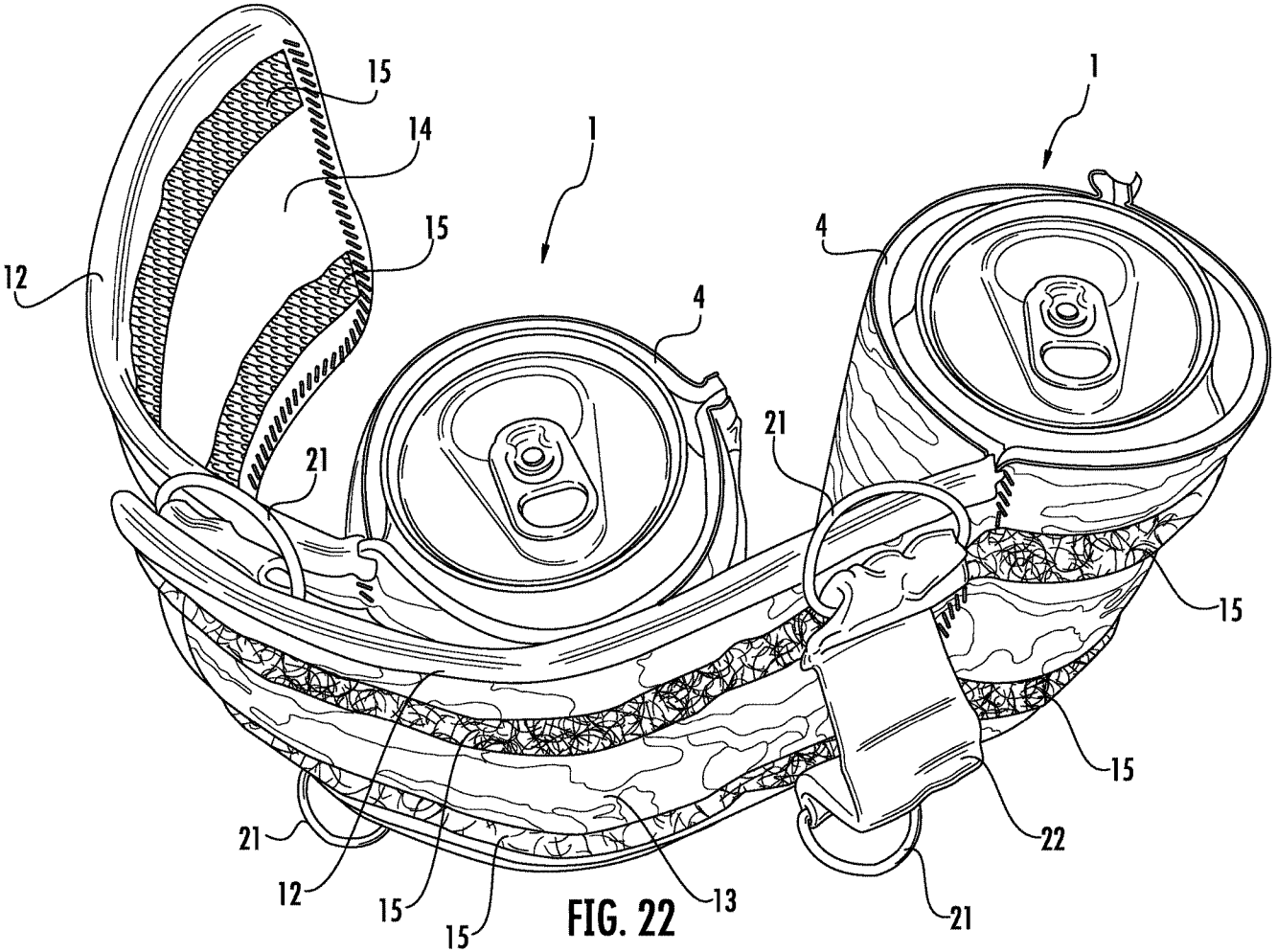
Figure 23:
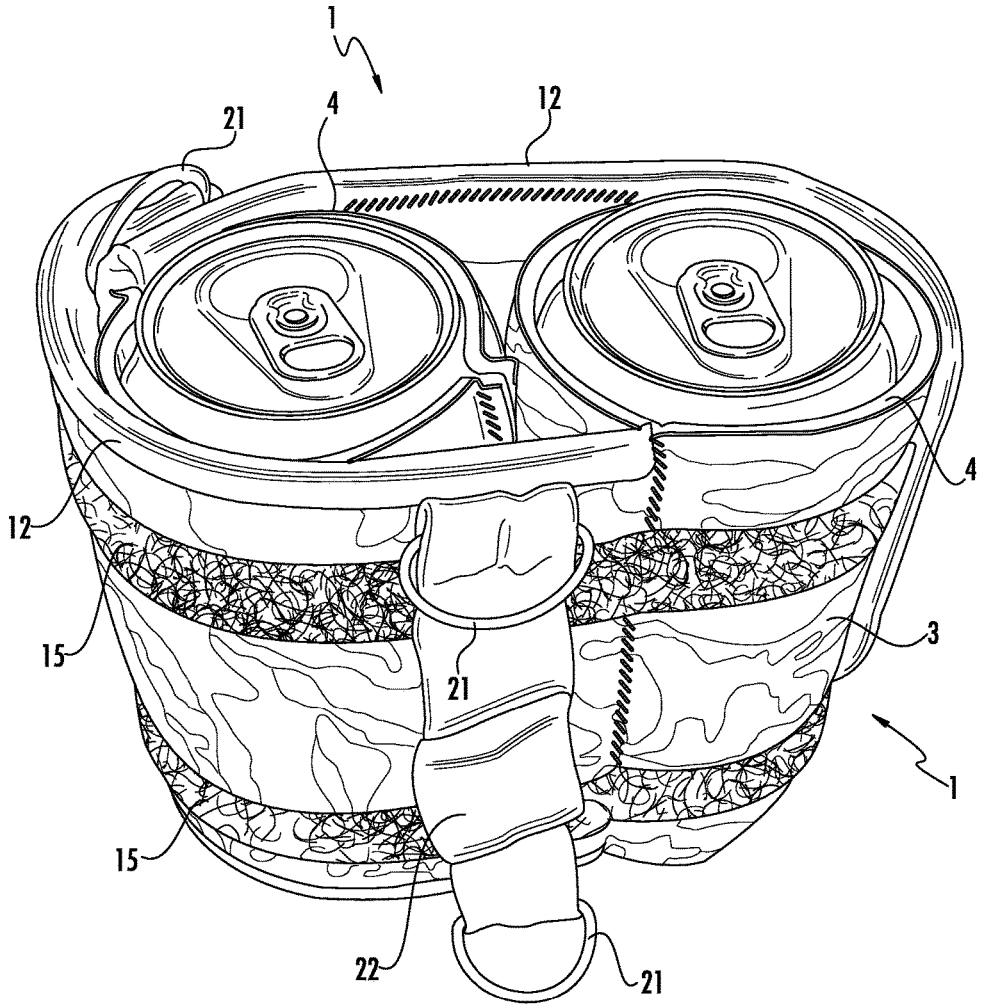
Figure 24:
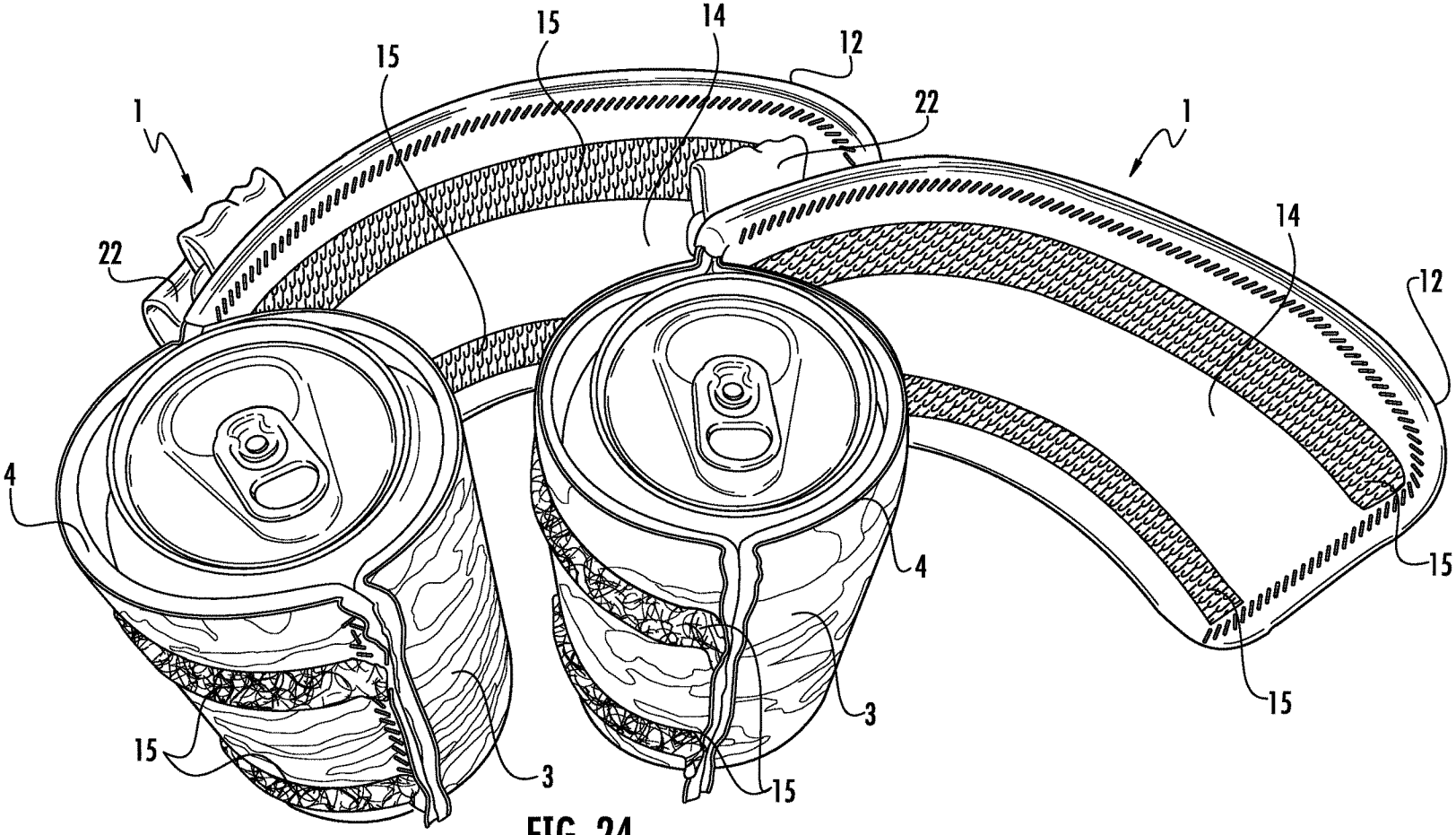

In the accompanying drawings and photographs, there is disclosed herein a beverage holder 1 which includes a base 2 and a wall 3 extending away from the base 2 to a rim 4 surrounding an opening 5. The rim 4, wall 3 and base 2 defining a space 7 within which a beverage 10 can be held in use. The beverage can be any type of beverage and of various diameters. A longitudinally extending flap 12 extends from the wall 3 and has a first side 13 and a second side 14. The flap 12 can be connected to the wall 3 in any typical way or be integrally formed. Fastening means 15 is locatable in use on the first side 13 and second side 14 so that in use the flap 12 can extend about the wall 3 so that the fastening means 15 of the first side 13 can connect with the fastening means 15 of the second side 14 and/or another like holder 1.

In the preferred form, the fastening means 15 includes hook and loop type fasteners as shown. In particular, at least two elongate strips of hook and loop fasteners 15 extend along the flap 12 and about the wall 3. It should however be appreciated that the fasteners 15 do not need to be hook and loop type fasteners and could be any typical type of fastener. The flap 12 however should be sufficiently elongate so that it can be wrapped at least partially about the wall 3 or sufficiently long enough to support the force required to secure like holders 1 together. The holder 1 further includes further fastening means 20 which include rings 21 and handle 22. The handle 22 being made of sufficient material so that it is sufficiently flexible so that a user's hand may pass between the handle 12 and wall 3 so that a user can grip the wall 3 or could alternatively be used simply as a typical handle 22. The invention can also include a bag strap 40 that clips to the rings 21.

In the preferred form, the wall 3 and flap 12 are made of the same neoprene material. However, it should be appreciated that they could be made of different materials from each other. The material should provide insulation in the preferred embodiment but could be made of any material with insulation or not. For example, canvas, plastic, woven synthetic fibers or the like.

The holder 1 can be connected to like holders 1 so that a plurality of holders 1 can hold a plurality of beverages 10 simultaneously. This provides significant advantages to a user when carrying beverages 10. Further, those beverages 10 can come in any type of beverage size, such as cans, bottles or the like. As the opening 5 can be varied by tightening the flap 12 about the wall 3 so that "skinny" bottles or the like can also be held. As the neoprene material is flexible the wall 3 and opening 5 can also be extended outwardly to cover quite large bottles. Advantageously, this invention provides a large range of flexibility in its carrying abilities.

The holder 1 can also include an aperture 30 creating a pocket for retaining items such as coins, keys or the like. That aperture 30 may also include a zip or other such fastening means. The holder 1 can therefore be used while exercising or moving about or hands free.

In a preferred form, the beverage holder 1 is constructed from a single piece of strong flexible material such as neoprene (wet suit material) with a band of Velcro™ around the outside and a carry handle. However, it could be made of any suitable material. Preferably, the holder 1 can have a design printed on its surface for promotional reasons. Preferably, the holder 1 can hold an ice block or the like to keep other connected surrounding holders 1 cool. The holder 1 can carry any beverage size as the holder 1 can be tightened or loosened to suit the beverage.

In another embodiment, the holder 1 consists of a single piece of 3 mm Neoprene (wet suit material) that is folded in half lengthwise along an axis X and sewn into pockets. A Velcro™ strip runs the length of the holder 1. This Velcro™ strip holds the holder 1 together when it is rolled up and also gives the entire holder 1 additional structural rigidity. The end of each pocket is slightly reduced in size by stitching to ensure that the beverages 10 don't fall out. There is a handle that runs along the Velcro™ strip that is in an appropriate position for carrying the holder 1 regardless of how many beverages 10 are being carried. Storage is also simple as the holder 1 can either be rolled into approximately the size of a standard holder 1, or hung by the handle from a convenient hook for ease of access.

Although the invention has been described with reference to specific examples, it will be appreciated by those skilled in the art that the invention may be embodied in many other forms.

The invention claimed is:

1. A holder for a beverage container, the holder including:

a base;

a wall extending longitudinally upwardly away from the base to define an opening for receiving the beverage container, the wall terminating at a rim surrounding the opening, the holder having a longitudinal axis extending from the base to the opening; and a flap connected to the wall and extending perpendicularly relative to the longitudinal axis and outwardly from the wall, the flap having at least one first fastener on one side and at least one second fastener on an opposite side, wherein the holder is a first holder and the at least one first fastener is adapted to cooperate with the at least one second fastener to fasten together, wherein the at least one first fastener of the flap of the first holder connects to a fastener of a flap of a second holder having a same structure as the first holder such that the first holder and the second holder are connected in an upright position when positioned so that the flap of the first holder and the flap of the second holder overlap one another and the at least one first fastener of the first holder cooperates with at least one fastener of the second holder to connect the first holder and the second holder.

2. The holder of claim 1, wherein said wall includes insulating material.

3. The holder of claim 1, wherein said wall includes neoprene.

4. The holder of claim 1, further including a pair of ring attachments attached to the wall and a strap, wherein each end of the strap is adapted to connect to a respective ring to form a handle.

5. The holder of claim 1, wherein the holder includes a pocket to store items.

6. The holder of claim 1, wherein the flap is adapted to fasten to the wall to secure the beverage container within the opening.

* * * * *